US009987507B2

(12) United States Patent
Add

(10) Patent No.: US 9,987,507 B2
(45) Date of Patent: Jun. 5, 2018

(54) PERSONAL ESCAPE AND RESCUE DEVICE

(71) Applicant: Shlomo Add, Herzliya (IL)

(72) Inventor: Shlomo Add, Herzliya (IL)

( * ) Notice: Subject to any disclaimer, the term of this patent is extended or adjusted under 35 U.S.C. 154(b) by 0 days. days.

(21) Appl. No.: 13/772,938

(22) Filed: Feb. 21, 2013

(65) Prior Publication Data

US 2013/0213736 A1 Aug. 22, 2013

Related U.S. Application Data

(60) Provisional application No. 61/601,647, filed on Feb. 22, 2012.

(51) Int. Cl.
*A62B 35/00* (2006.01)
*A62B 1/14* (2006.01)

(52) U.S. Cl.
CPC ..... *A62B 35/0018* (2013.01); *A62B 1/14* (2013.01)

(58) Field of Classification Search
CPC .... A62B 1/00; A62B 1/02; A62B 1/14; A62B 1/16; A62B 1/20; A62B 17/00; A62B 35/0018; A62B 35/0037; A62B 35/0043
USPC ..... 182/5
See application file for complete search history.

(56) References Cited

U.S. PATENT DOCUMENTS 133,870 A * 12/1872 marshall ..... A62B 1/14 188/65.5
266,998 A 11/1882 Judd
291,940 A 1/1884 Robertson
368,075 A * 8/1887 diss ..... A62B 1/10 182/193
440,161 A * 11/1890 jeffers ..... A62B 1/14 182/193
482,813 A * 9/1892 schwarz ..... A62B 1/14 182/193
503,971 A * 8/1893 jewell ..... A62B 1/14 182/193
632,692 A * 9/1899 boehme ..... A62B 1/14 182/5

(Continued)

FOREIGN PATENT DOCUMENTS

GB 2296855 7/1996
WO WO-2007037563 A1 * 4/2007 ..... A62B 1/14

OTHER PUBLICATIONS

U.S. Appl. No. 61/607,647, filed Feb. 22, 2012, Add.

*Primary Examiner* — Katherine W Mitchell
*Assistant Examiner* — Candace L Bradford
(74) *Attorney, Agent, or Firm* — PatShegen IP

(57) ABSTRACT

A personal escape and rescue device comprising a descent mechanism having a pair of plates having opposing undulating faces each comprising at least one peak and at least one trough defined along the length of the undulating face, and a control mechanism for displacing the plates relative to one another in a direction along the length of the undulating faces thereby adjusting the disposition of the opposing undulating faces relative to one another thereby setting the distance between the trough and the opposing peak; a body harness to support a descender, the descent mechanism being attached at an upper location of the harness whereby the descender is in a stable position; and a strap/cable, of a length to provide descent to safety, reeved between the faces of the descent mechanism, and comprising an anchoring arrangement.

20 Claims, 7 Drawing Sheets

(56) References Cited

U.S. PATENT DOCUMENTS 866,144 A * 9/1907 kobert ..... F16G 11/00 24/115 R
899,984 A * 9/1908 fry ..... A62B 1/14 188/65.3
930,580 A * 8/1909 weinstock ..... A62B 1/10 182/236
1,158,952 A * 11/1915 amman ..... A62B 1/14 188/65.5
1,233,366 A * 7/1917 keator ..... F16B 7/22 24/134 L
1,690,720 A 11/1928 Cosby
3,049,896 A 8/1962 Webb
3,911,913 A * 10/1975 June ..... A41D 13/018 128/201.29
4,266,744 A * 5/1981 Bergman ..... H02G 11/00 187/228
4,550,801 A 11/1985 Forrest
4,588,046 A 5/1986 Van Der Neer et al.
4,594,752 A * 6/1986 Garner, Sr. ..... F16G 11/101 24/132 R
4,603,755 A * 8/1986 Meschke ..... A62B 1/14 182/193
4,651,351 A * 3/1987 Endo ..... A62B 1/14 182/129
4,887,694 A * 12/1989 Ho ..... A62B 1/02 182/141
5,068,949 A * 12/1991 Horace ..... F16G 11/101 24/115 R
5,107,956 A 4/1992 Constantinis et al.
5,145,036 A 9/1992 Omalia
5,379,858 A * 1/1995 Sandoval ..... A62B 1/14 182/193
5,421,326 A * 6/1995 Rankin ..... A41D 13/0053 128/201.11
6,708,927 B2 * 3/2004 Chen ..... A62B 1/22 182/230
8,695,249 B1 * 4/2014 Al Hasan ..... G09F 21/00 182/141
2003/0079939 A1 * 5/2003 Wang ..... A62B 1/14 182/5
2004/0112673 A1 * 6/2004 Bodinger ..... A62B 1/08 182/6
2007/0169993 A1 * 7/2007 Rhee ..... A62B 1/02 182/3
2009/0277718 A1 * 11/2009 Gordon ..... A62B 1/02 182/3
2010/0122874 A1 * 5/2010 Harris, Jr. ..... A62B 1/14 182/231
2013/0068561 A1 * 3/2013 Harris, Jr. ..... 182/231
2017/0197116 A1 * 7/2017 Merritt ..... A63B 29/024

* cited by examiner

PERSONAL ESCAPE AND RESCUE DEVICE

CROSS-REFERENCE TO RELATED APPLICATIONS

This application claims priority to U.S. Provisional Application No. 61/601,647 filed on 22 Feb. 2012, the contents of which are incorporated herein, in their entirety, by this reference.

TECHNICAL FIELD

This invention relates to devices or equipment for personal escape and rescue, particularly to devices facilitating descent from buildings or other elevated structures in emergency situations, by means for gliding about a cable.

The interchangeable terms strap/cable/rope as used herein the specification and claims denote any cable of suitable material and sufficient length.

BACKGROUND

Ever since the advent of tall buildings and structures in which many people live, work or visit, it has been a safety concern to safely facilitate escape/rescue of such people in emergency situations. Emergency escape may be needed in a variety of situations such as earthquakes, fire, and terror attacks—especially from higher levels of structures where ladders or other conventional rescue equipment do not conveniently reach and when rescue personnel simply cannot respond quickly enough.

A variety of devices are known in the crowed art of equipment for emergency descent. Among the many known devices, a variety makes use of equipment for gliding about a cable. These generally incorporate a descent mechanism comprising a rope (or cable) wound around a spool or drum a rope threaded through a pulley system or a rope or strap snaking through a plurality of rods, thereby imparting friction and retarding the rate of descent or facilitating the control of descent rate.

The devices further incorporate, or are designed for use with, harnesses—having a means of attaching the harness to the decent mechanism—and an anchoring means.

The disclosures in U.S. Pat. No. 5,379,858 to Sandoval; U.S. Pat. No. 5,145,036 to Omaha; U.S. Pat. No. 4,550,801 to Forrest; and U.S. Pat. No. 503,971 to Jewell illustrate examples of more closely related prior art due the geometry of their descent mechanisms or the descent characteristics as a result of the design.

U.S. Pat. No. 5,379,858 describes a descender system comprising an elongated strap channeled through a descent mechanism having five parallel cylindrical pins supported side-by-side. The strap is serpentinely channeled through an upper set of three adjacent pins; the fourth pin is used to provide friction on the strap for controlling the rate of descent via pressure from a rotatable knob; and the fifth pin secures a harness to the descent mechanism.

U.S. Pat. No. 5,145,036 discloses a descent-retarding device comprising a U-shaped steel frame with five cross bars. Two of the crossbars can be swung open to facilitate reeving a rope over and under the bars. Springs coiled around arms of the U-shaped steel frame provide compression on the rope and crossbars to provide friction and slow the sliding of the rope. The lowest cross bar, adjacent the springs, is long enough to be grasped and can be pulled down to reduce the spring compression on the rods and rope thereby increasing the rate of descent. When this cross bar is completely released, the springs expand to bring the user to a complete stop.

However, both of the above-mentioned patents disclose descending systems that require user input to control the descent. Such devices could prove useless to a user who is likely to be anxious, confused or may even lose consciousness during descent, due to the stress of an emergency that would require the use of such a device.

U.S. Pat. No. 4,550,801 discloses a device that overcomes the above-mentioned issues with an apparatus including a load-lowering device in the form of a small cylindrical drum or spool. Rope is wound around the spool to provide friction and is also threaded through apertures in the upper and lower ends of the spool. The lower aperture has tapered slits on either side and due to the clockwise (or counterclockwise) rotation of the rope on the spool, there is a tendency for the rope to be biased toward one of either of the tapered slits thereby providing more friction and slowing descent. If the user is alert, he or she may press on the rope to remove it from the slit and thereby increase the rate of descent. However, the use of the hands may result in rope burn or the user's hand could get caught between the rope and the mechanism causing pain or, even worse, possibly stopping descent to safety.

In the crowded art, there are other disclosures of safety devices for descending from heights that do not require the user to control descent speed, however these devices typically suffer from one or more of the following issues including: complicated mechanisms, bulky mechanisms, intricate rope/strap threading or reeving patterns allowing problems such as abrading or tangling, unstable harnesses (sometimes requiring a user to hang on to a component in order to maintain stability), harnesses that are complicated or difficult to don, etc.

Furthermore, none of the prior art descender systems incorporate a means of protecting a user descending from a building or tall structure from receiving blows from items such as the outer wall of the building or its ledges, etc.

SUMMARY

It is an object of one or more embodiments of the present invention to provide a personal escape and rescue device allowing a user to safely and securely descend from a building or tall structure substantially without the need for the user to control descent rate. The device has a simple descending mechanism, is lightweight, does not require assembly and includes a supporting body harness that provides a stable user descent position.

It is a further object one or more embodiments of the present invention to provide a personal rescue device for allowing a user to safely and securely descend from a building or tall structure while being protected from possible blows from items such as the building's outer walls or ledges, etc.

According to one embodiment of the present invention there is provided a personal escape/rescue device for allowing a user to descend from a building or tall structure substantially without the need for the user to control descent speed, comprising (a) a descent mechanism comprising a pair of plates having opposing undulating faces each comprising at least one peak and at least one trough defined along the length of the undulating face, and a control mechanism for displacing the pair of plates relative to one another in a direction along the length of the undulating faces thereby adjusting the disposition of the opposing undulating faces of the plates relative to one another thereby setting the distance between the trough and opposing peak (b) a body harness for securely holding and supporting a descending user, the descent mechanism being attached to said harness at an upper location on the harness whereby the descending user is in a stable position, and (c) a strap/cable, of a sufficient length to provide descent to safety, reeved between said opposing faces of said descent mechanism, and comprising an anchoring arrangement attached at an upper end thereof.

According to another embodiment of the invention the body harness of the rescue device further comprises an inflatable user-protection covering for protecting the user from possible blows or injury during descent.

According to yet another embodiment of the invention the descent mechanism of the rescue device further comprises a strap straightening member to ensure the strap is not tangled when entering the opposing faces of the descent mechanism. According to a modification of the invention, the device comprises two descent mechanisms arranged in series.

According to yet another embodiment of the invention the distance between the opposing faces of the descending mechanism of the rescue device is pre-set for users of a predetermined weight range thereby providing a safe descent rate. The device, according to a particular design, may comprise several pre-set plate positions to correspond with several user weight ranges.

The personal escape/rescue device according to one or more embodiments of the present invention allows a user to descent from a building or tall structure with the following advantages:

1) The descending mechanism can be pre-set, corresponding to a user's weight (or weight range) thereby not requiring user input to adjust the speed of descent. Thus, if the user becomes dis-oriented or even loses consciousness during descent, both of which are common when under the stress of an emergency escape from a tall structure, he or she will descend safely.

2) The descending mechanism is integral or fixed to the body harness at a high front portion thereof resulting in the user descending in a stable position.

3) The descent mechanism is designed for use with a strap, which is much lighter and less bulky than a rope and takes up less space when stored.

4) The descent mechanism may include a strap straightener to prevent tangling of the strap.

5) The device is simple to operate and the user needs no auxiliary help to prepare the device or to descend.

6) The body harness may include an outer protection jacket or inflatable protection covering to protect a descender from receiving blows from the building's outer wall, ledges, etc.

7) The descent mechanism of the device is pre-reeved thus not requiring one to thread or reeve while under the stress of an emergency situation.

8) The strap of the device may have a weight at its distal end to aid in positioning the strap and/or keeping the strap taught prior to descent.

9) The weight at the distal end of the strap may further incorporate a mechanism to take-up any slack in the strap to avoid tangling and getting caught on obstacles—including other descenders.

10) The body harness of the rescue device is simple and self-explanatory to wear having no items such as dangling support loops to maneuver into.

11) The descent mechanism is integral or fixedly attached to the harness, and so does not require attachment of the descent mechanism to the harness.

BRIEF DESCRIPTION OF THE DRAWINGS

In order to understand the invention and to see how it may be carried out in practice, some embodiments will now be described, by way of non-limiting examples only, with reference to the accompanying drawings, in which.

DETAILED DESCRIPTION

Figure 1:
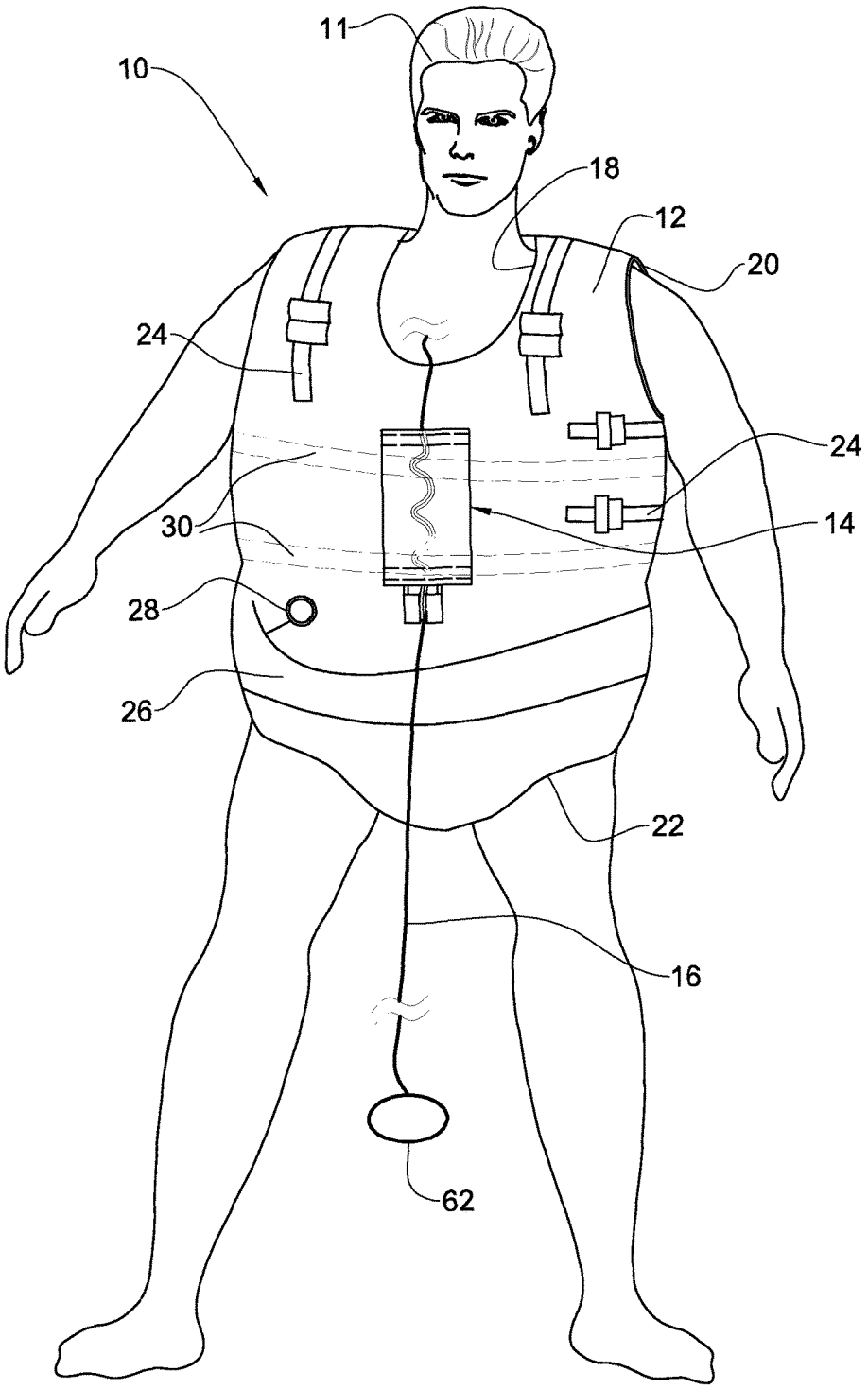
FIG. 1 is a front view of a user wearing a personal rescue device according to an embodiment of the presently disclosed subject matter in a closed position.

Referring first to FIG. 1 of the drawings, a personal escape/rescue device, generally designated 10, is shown being worn by a user 11. The device 10 comprises a body harness 12, a descent mechanism 14 attached thereto, and a descent strap 16 that is reeved through the descent mechanism.

The body harness 12, which is typically made of a strong and stretchy material to provide a physically and psychologically safe and secure fit, has head, arm and leg openings 18, 20 and 22, respectively. For added comfort and flexibility of fit, the harness 12 may include several size adjustment straps 24.

The harness 12 further comprises an inflatable user-protection covering 26, shown in FIG. 1 in the non-deployed state, having an actuating arrangement such as a handle or actuating ring 28 to execute deployment and is located convenient to hand grasp. The harness 12 is shown with the covering 26 in its deployed state in FIG. 4 and will be discussed in more detail below. It is seen that the inflatable user-protection covering 26, which may appear as a vest in its non-deployed state is at a position adjacent the user's chest, waist or hips so that it will protect a significant portion of the user upon inflation The descent mechanism 14, which will be discussed in detail below, can be integrally attached to the harness 12 at a front upper portion thereof so as to provide the user 11 with a comfortable descent position—in particular a position which does not allow the user to fall backward. The integral fixing of the descent mechanism 14 to the harness 12 obviates the user 11 from any need to attach the descent mechanism to the harness. The descent mechanism 14 can be sewn in and/or held by an arrangement such as strong cross-body straps 30. The straps 30 are illustrated with phantom lines to indicate that they may be internal to the harness 12 for a strong strap-to-harness connection, although the straps may wrap around the harness and be connected by methods, for example, such as sewing or via belt-loops (not shown).

In FIG. 2 is seen a detailed view of the descent mechanism 14 comprising a pair of plates 40 and 40' attached by connector bars 42 and 42' (two shown here) fastened to the plates by fasteners 43. The bars 42 and 42' hold the plates 40 and 40' at a pre-determined disposition relative to one another with a gap 47 therebetween, having a predetermined width. The width of the gap 47 can be set to determine the speed that the strap 16 slides between the plates 40 and 40'—for a given descender. The plates 40 and 40' includes opposing undulating faces 44 and 44', respectively, each comprising respective peaks 46 and troughs 46' defined along the length of the undulating faces between which the descent strap 16 is reeved. Each of the peaks 46 of plate 40 is disposed in a trough 46 of the opposing plate 40' and vice versa. The descent mechanism 14 is shown further comprising a strap straightening member 48, connected thereto by arms 50, for ensuring that the descent strap 16 is straight prior to its entering the descent mechanism. To aid in straightening potential twists in the descent strap 16, the straightening member 48 can comprise a upwardly tapered entry 52, which is adapted to allow the strap to enter therein only when is not twisted. The straightening member 48 is typically disposed close to the lower end of the plates 40 and 40' to preclude tangles from re-forming in the strap 16 prior to entering the plates. When the strap 16 passes through the straightening member 48, it is preferably completely internal to the straightening member (as illustrated with phantom lines) to keep the strap therein and to ensure that the strap is aligned between the plates 40 and 40'. Due to the narrow entry 52 of the straightening member 48, the strap 16 cannot slide in while being folded or twisted. In that case the tapered portion urges the strap 16 into the gap 47 while straightening the edges thereof.

Figure 2A:
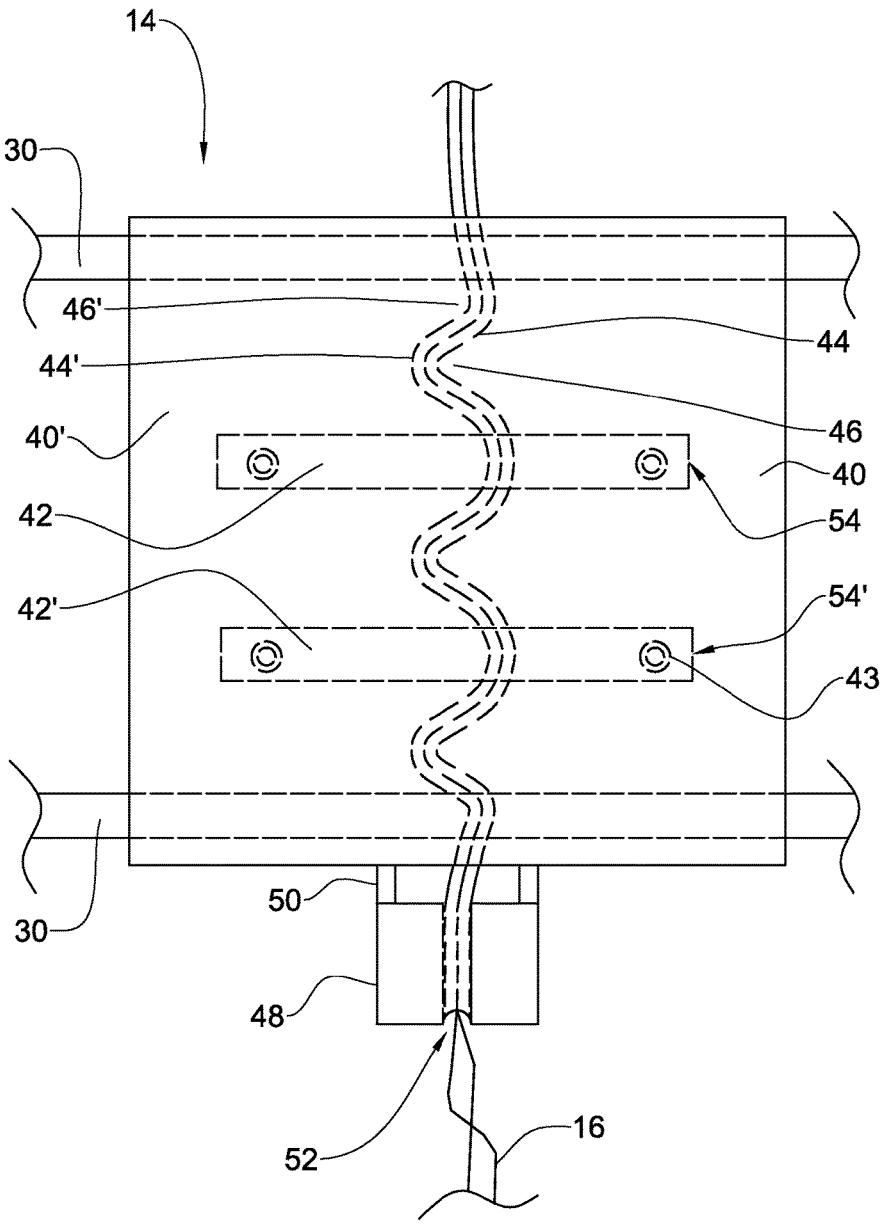
FIG. 2A is a front view of a descent mechanism of the personal rescue device according to an embodiment of the present invention.
Figure 2B:
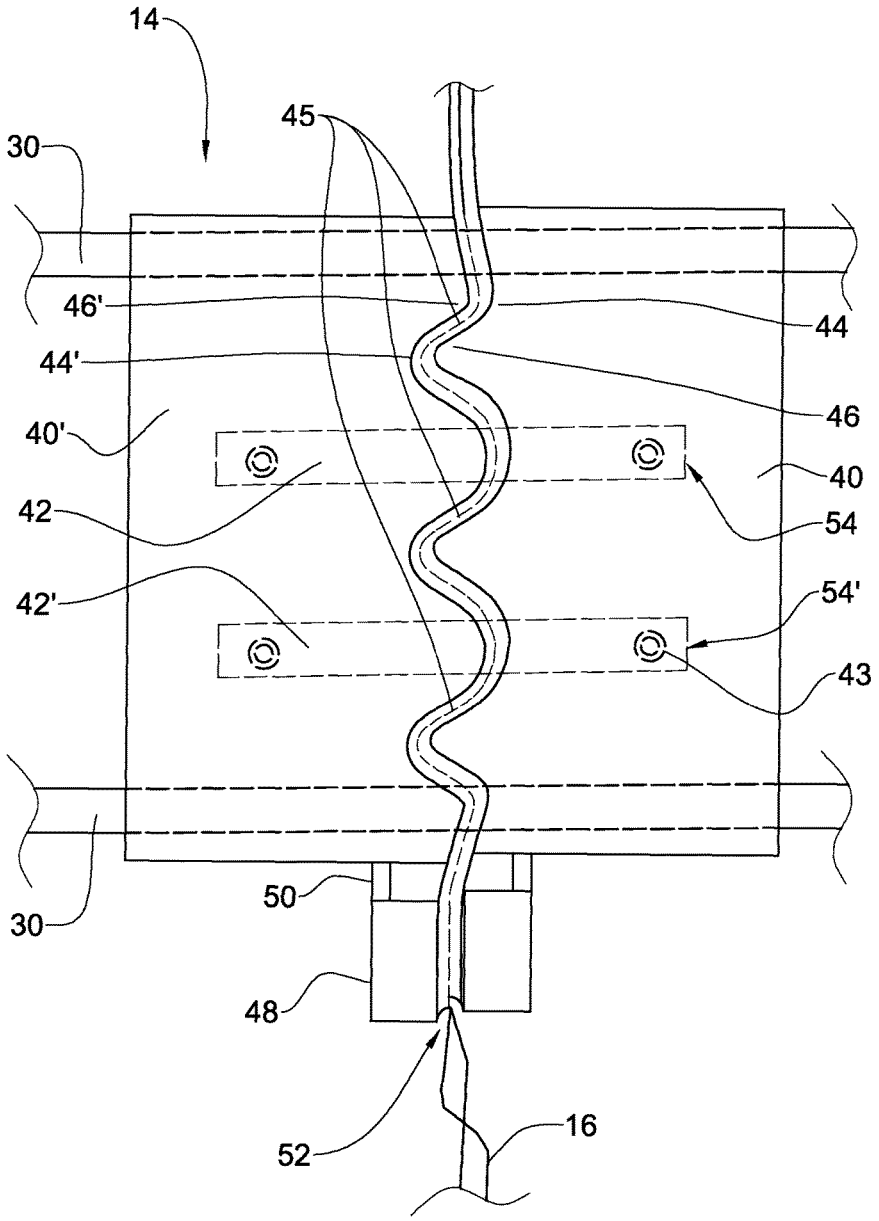
FIG. 2B is the descent mechanism of FIG. 2A in an unaligned position.
Figure 2C:
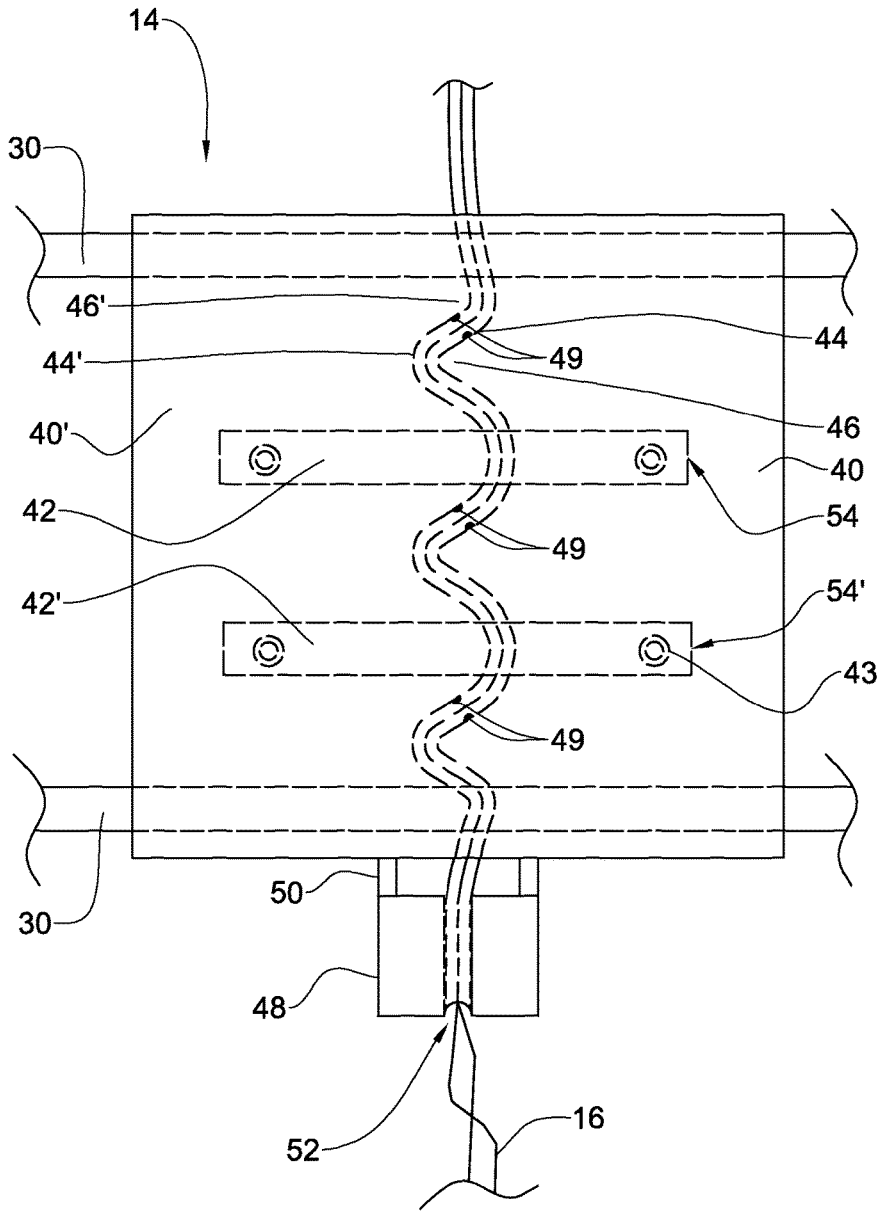
FIG. 2C is the descent mechanism according to another example of the presently disclosed subject matter

The pair of plates 40 and 40' are located adjacent to each other, as shown in FIGS. 2A-2C, providing a pair of adjacent plates 40 and 40' configured to define a vertically oriented undulating passageway between the adjacent plates.

Figure 5:
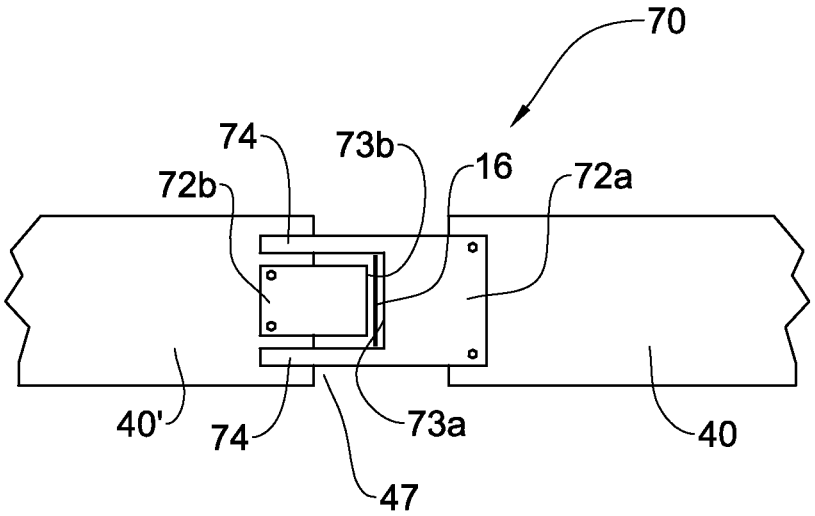
FIG. 5 is a front view of a straightening element according to an example of the presently disclosed subject matter.

Referring now to FIG. 5, the straightening element according to another example, generally designated 70 can include a first side member 72*a* having a flat face 73*a* and mounted at the bottom of plate 40, such that a flat face 73*a* is aligned with the undulating face 44 thereof. The first side member 72*a* includes retaining arms 74 extending from the edges of the flat face 73*a* and defining a space 76 therebetween. The straightening element 70 further includes a second side member 72*b* having a flat face 73*b* and mounted at the bottom of the opposing plate 40', such that a flat face 73*b* is aligned with the undulating face 44 thereof. The second side member 72*b* is configured to be disposed between the two retaining arms 74 of the first side member 72*a* and to freely move in the horizontal direction away from or toward the first side member.

When the flat face 73*a* of the first side member 72*a* is adjacent the flat face 73*b* of the second side member the descent strap 16 cannot be extended therethrough. However when the second side member 72*b* is slightly shifted sidewardly, such that the flat face 73*b* thereof disengage the flat face 72*b* of the first side member 72*a*, the strap 16 can be extended therethrough. The space between the flat face 73*a* of the first side member 72*a* and the flat face 73*b* of the second side member 72*b* serves as a channel for the strap 16, the width of which is determined in accordance with the width of the strap. That is to say, the strap can freely slide through the channel, however the flat faces do not allow the strap to be folded or twisted therein. This way, when the strap 16 enters the gap 47 between the plates 40 and 40' it is free of twisted and folds. The two retaining arms 74 are configured to retain the strap 16 inside the channel. This way, when a user descends from a building, due to the center of the weight of the user's body, an angle is formed between strap extending from the building and the rescue device 10. In this position and angle can be further formed between the rescue device 10 and the strap extending therefrom downwardly towards the ground. This angle can render the use of the rescue device difficult, since in this position the strap 16 is urged to displace out of the gap 47. Thus, the retaining arms 74 retain the strap 16 in place and ensure a perpendicular disposition of the strap with respect to the gap entry at the bottom of the plates 40 and 40'.

According to an example the top portion of the plates 40 and 40' can further include retaining mean for ensuring a perpendicular disposition of the strap 16 at the exit of the gap 47. The retaining means can be a straightening element, similar to that which is disposed at the bottom of the plates 40 and 40'.

In FIG. 2A the plates 40 and 40' are shown in what can be referred to as aligned disposition wherein the undulating faces 44 and 44' are positioned in such a way that each peak 46 is aligned with the opposing trough 46'. In this position the gap 47 between the face is substantially constant as each peak 46 is in registration with the opposing trough 46', thus there would be relatively less friction on the descent strap 16 and thus this position represents a spacing or setting designed for a light user 11 (or alternatively for a rapid descent).

To adjust the descent mechanism 14 to suit users 11 of different weights, or to set the rate at which users of a given weight range would descend, the plates 40 and 40' are adjusted so that the faces 44 and 44' longitudinally moved up or down relative to one another in a direction along the length of the faces 44 and 44', thereby setting the distance between each trough and its opposing peak.

Figure 3:
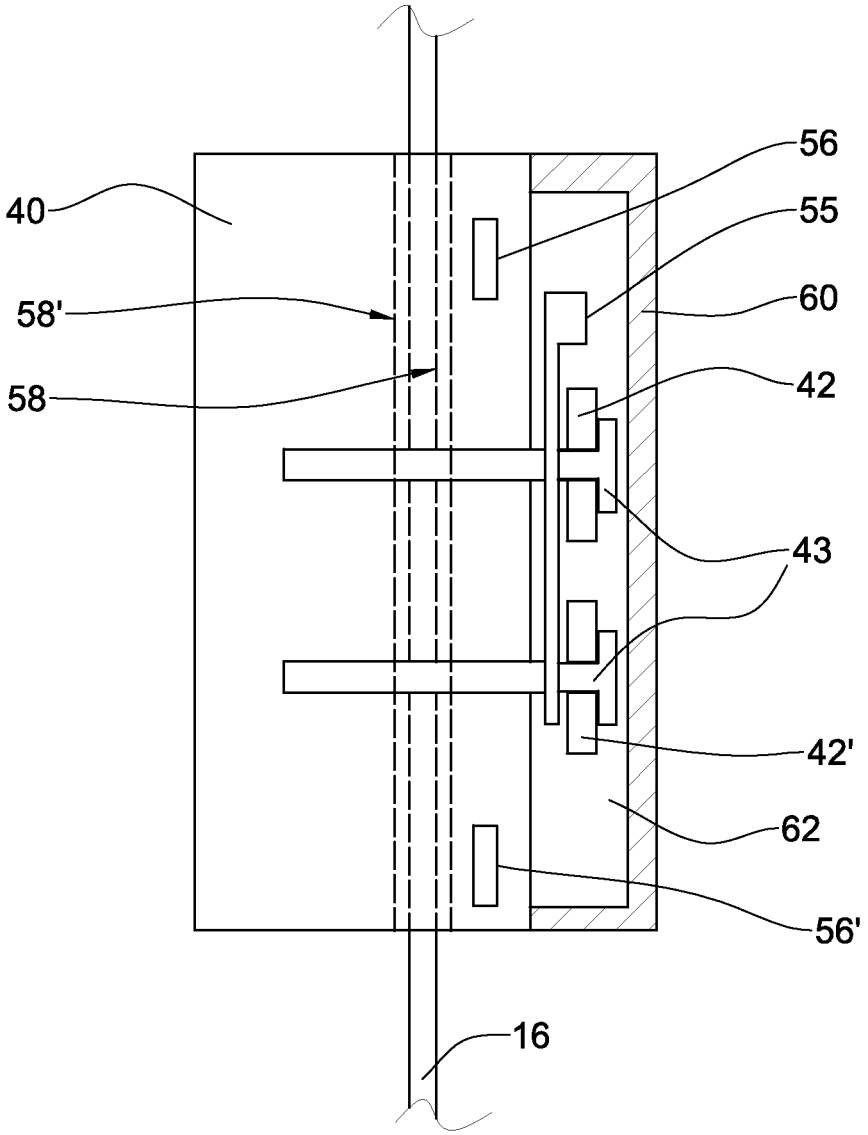
FIG. 3 is a section of FIG. 2A along the lines A-A.

As can clearly be seen in FIG. 3, in this position, each a portion of each peak is disposed slightly closer to a portion of the opposing trough, thus, increasing the friction of the strap 16 and the faces 44 and 44' at that location, here indicated as 45.

This is accomplished by pushing ends of the connector bars 42 and 42' associated with the same plate 40 or 40'—say right ends 54 and 54' as shown in FIG. 2—in either the upward or downward direction. Due to the direct attachment of both bars 42 and 42' to both plates 40 and 40', pushing on either bar will move them both simultaneously up and down relative to one another in a parallel direction to the interfacial axis while precluding the plates from displacing towards one another in a direction transverse to the parallel direction. Optionally, an additional component such as a handle or lever 55 may be used to move the bars 42 and 42'. The plate-to-plate disposition can be fixed in place by means such as a combination of a biasing spring and a locking feature (not shown) or one of several other known means.

As shown in FIG. 2B, longitudinally, moving ends 54 and 54' from the "aligned" position shown in FIG. 2 in either direction will bring a portion of each peak 46 of one face 44 to a portion 45 of the opposing trough 46' on the other face 44' thereby providing increased friction on the descent strap 16 at least around portion 45. It is appreciated that when first plate 40 is moved upwardly relative to the second plate 40', the width of the gap 47 does not remain constant throughout the undulating face. For example, while the gap in the upper portion of the peak 46 and its corresponding trough 46' may be reduced, the gap in the bottom portion thereof is now larger. However since the friction in some portions is increased, here indicated as portion 45, the descending speed is reduced. This situation is appropriate for heavier users 11 or, for a slower descent for a user of a particular weight. Contrarily, moving the faces 44 and 44' closer to the "aligned" position would set the descent mechanism 14 for lighter users 11, or a more rapid descent for a particular user.

It will be noticed that phantom lines have been used for illustrating faces 44 and 44' and strap 16, when between those faces, as well as connector bars 42 and 42' and fasteners 43 thereby indicating that these components are internal to the descent mechanism 14. Alternatively, these components need not be internal, however the internal positioning helps protect them from harm such as from dust, friction and the like.

Referring now to FIG. 2C, according to one example, the aforementioned location 45 in which the friction of the straps between the faces 44 and 44' increases can include other friction element 49*a*, such as a spherical body disposed on face 44 at that location. An opposing frication element 49*b* can be disposed on the opposing face 44' at the same location. The friction element 49 can be disposed on each trough of faces 44 and 44', thus increasing the friction with the strap 16.

In case both faces 44 and 44' include one or more friction element 49, as the plates are longitudinally moved up and down with respect to one another, the friction elements 49 of each peak is disposed slightly closer to an opposing friction element 49 thus, increasing the friction of the strap 16 sliding between the friction elements 49 and 49. FIG. 3 shows a section along lines A-A of FIG. 2A providing further details of the descent mechanism 14. Slots 56 and 56' are shown disposed in a portion of plate 40 (and plate 40'—FIG. 2), for threading cross-body straps 30.

With reference to FIGS. 2 and 3, strap 16 is shown to be completely internal to plate 40 and plate 40' having a minimal clearance between its width the faces 44 and 44' of plates 40 and 40', respectively, as well as between the thickness of strap 16 and the internal faces 58 and 58' (shown with phantom lines).

Further shown is a cover 60 covering a side of the plates 40 and 40' defining a space 62 therebetween which when opened provides access to connector bars 42 and 42' to allow for adjustment of the distance between faces 44 and 44', as previously discussed. The cover 60 protects the connector bars 42 and 42' from dust, et cetera and may attached to the plates 40 and 41' in any of a variety of arrangements known per se.

In one embodiment it is envisioned that the descent mechanism 14 will be pre-set for users 11 according to pre-determined weight ranges, prior to procurement of the rescue device 10. However, the cover 60 may also provide access for adjusting the descent characteristics by the user 11.

Accordingly, the descent mechanism 14 may be attached to the harness 12 such that cover 60 is facing the harness and the user 11 is blocked access thereto, or alternatively, the cover may face outward from a user. If facing outward, the option of opening the cover 60 is provided whereby the connector bars 42 and 42' can be adjusted by the user 11 (or another person) to set the plate-to-plate distance to a pre-determined position appropriate to the intended user's weight, or the connector bars can be moved to increase or decrease the descent rate of a given user 11. Indicia (not shown) may be provided to indicate an appropriate weight and/or rate settings. In case the connector bars 42 and 42' can be adjusted, each bar can include an adjusting screw replacing one of the fasteners 43. The adjusting screw can be for example arranged as a worn drive. That is to say each plate 40 and 40' include a threaded band, such that when the screw is turned, it acts as a worm drive pulling the threads of the band, causing the plate to move up or down.

Reverting to FIG. 1, the rescue device 10 may also include a ball or weight 64, which can aid in lowering the strap 16 prior to descent and also help keep the strap taught. In this regard, the weight 64 may comprise a mechanism (not shown) whereby the slack of the strap 16 is "taken up" after the weight has reached the ground. The weight 64 also comprise a rubber-like or other soft covering to reduce the chance of the weight injuring another individual who may also be exiting via the outside of the building.

Figure 4:
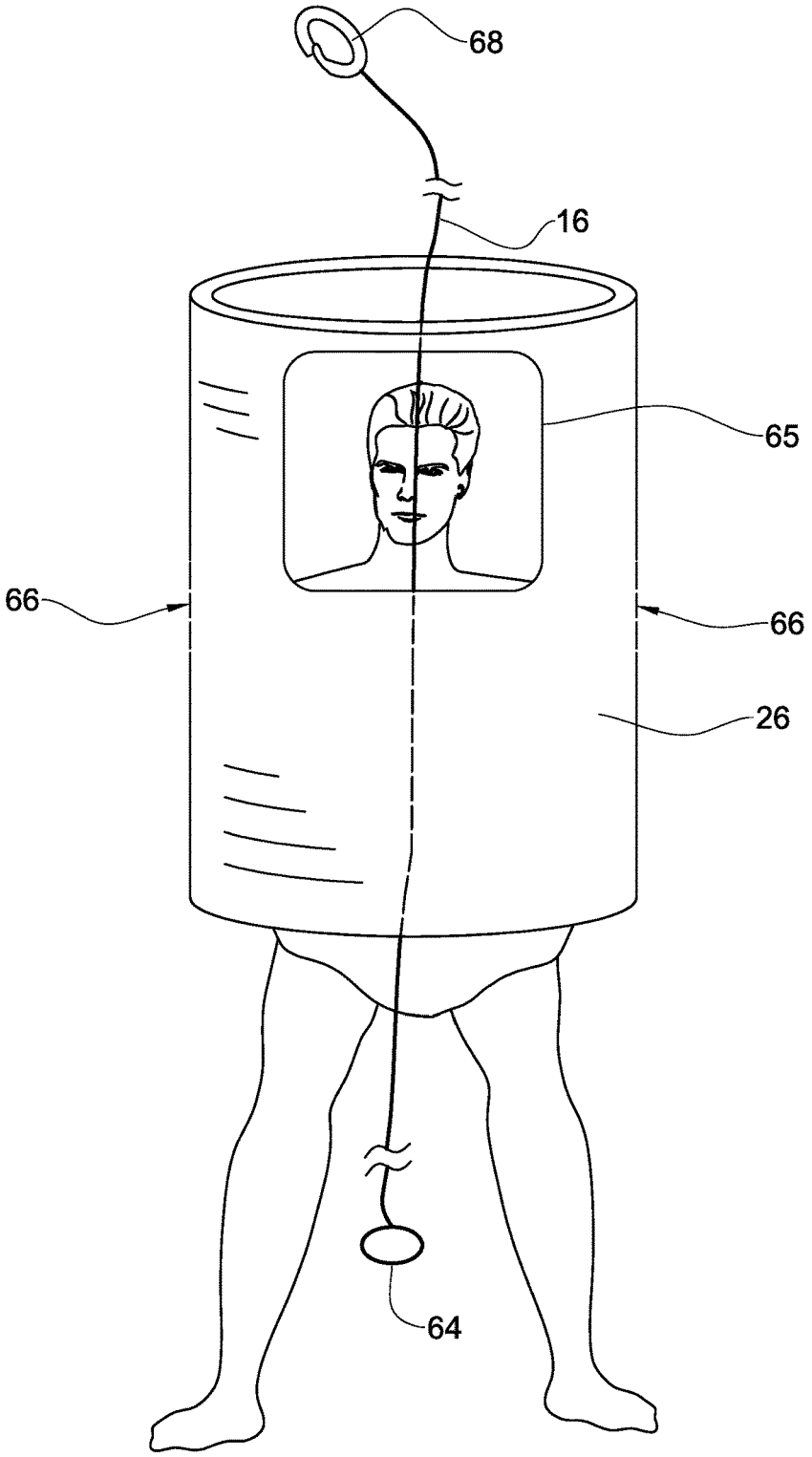
FIG. 4 is a view of an embodiment of the present invention illustrating deployment of its inflatable protection covering.

FIG. 4 shows the rescue device 10 in a mode wherein the inflatable user-protection covering 26—shown in FIG. 1 in the non-deployed state—has been inflated, by pulling the actuating ring 28 (FIG. 1) and has surrounded the user 11 in a protective shell. The covering 26 is configured to inflate as a barrel surrounding the majority of the user's body, including his head and upper body portion. This way the covering provides a mental separation and assists him in overcoming the fear of descending from the building.

The covering 26 can be provided with a clear window 65 to allow the user 11 a view and armholes 66, indicated by dashed lines, if the user desired or needed to reach out with a hand. The user 11 could alternately hold his or her arms inside the covering 26 thereby being provided a safe, secure and comforting space while descending.

For ease of use, the strap 16 is typically pre-reeved through the descent mechanism 14 and the straightening member 48, and arranged such that the upper end of the strap comprises an anchoring member 68 that is close to the descent mechanism and the lower portion of the strap is coiled in an orderly fashion.

Operation:

Prior to exiting the building, an anchoring member 68, illustrated in FIG. 4 as a hook, is attached to a suitable object within the building or fixed to the building, which can be done prior to or after donning the harness 12. After donning the harness 12 the user 11 lowers the weight 64 attached to the strap 16 of the rescue device 10, and exits the building, via a window or the roof for example. Once outside the building, the user 11 pulls actuator ring 28 to inflate the protection covering 26 and then descends. The user 11 does not need to do anything to control the descent rate, or do anything else, and he or she would safely descend to the ground.

However, regarding the earlier mentioned embodiment wherein the cover 60 is accessible to the user 11, the user, instead of descending at a predetermined rate, could control his or her descent rate, as previously indicated.

It should be noted that various components of the personal rescue device described above, as well as variations thereof are provided merely by way of illustration and are by no means exclusive, and many variations and modifications thereof are possible.

For example, cover 60 could be arranged to be non-openable (e.g. one-way screws, welded, etc.) whereby the descent mechanism 14 is pre-arranged to suit users 11 of a pre-determined weight range. The advantage here is that fewer options for the user 11 make the rescue device 10 simpler to use during the stressful time of emergency escape. This arrangement would have a similar result for the user 11 as the embodiment previously described wherein the cover 60 faced inward toward the harness 12 and access to adjustment was prevented.

In another option, the device 10 could further comprise a sack (not shown) within which the strap 16 is coiled. In this design the user 11 would not need to lower the weight 64 and the strap 16, rather, the coiled strap would uncoil while the user was descending.

According to another example, a back-up descent mechanism may be provided, which can be similar to the descent mechanism 14 described hereinabove, or can be a different descent mechanism as known in the art. The back-up descent mechanism can be arranged in series with respect to the main descent mechanism.

It will be appreciated that the above descriptions are intended only to serve as examples, and the many other embodiments are possible within the spirit and scope of the present invention.

The invention claimed is:

1. A personal rescue device for allowing a user to descend from a building or tall structure, the personal rescue device comprising:

a strap;

an anchoring arrangement connected to the strap, the anchoring arrangement configured for securing the strap to or within the building or tall structure;

a descent mechanism connectable to the strap, the descent mechanism comprising a pair of adjacent plates configured to define a vertically oriented undulating passageway between the adjacent plates for accommodating the strap when extending through the descent mechanism, the pair of adjacent plates having opposing edge faces oriented parallel relative to each other along a vertical interfacial axis, each edge face having an undulating surface comprising at least one peak or at least one trough positioned along a length of each face, the descent mechanism being configured to preclude displacement of the pair of adjacent plates towards one another along a direction transverse to the interfacial axis;

a control mechanism connected to the pair of adjacent plates, the control mechanism being configured for displacing the pair of adjacent plates relative to each other along the vertical interfacial axis for adjusting relative positioning of the undulating surfaces of the opposing edge faces of the pair of adjacent plates to adjust a vertical gap size between a side of one trough of one undulating surface and an adjacent side of an opposing peak of the undulating surface of the opposing edge face of the pair of adjacent plates; and a body harness connectable to the descent mechanism for securely supporting the user descending from the building or tall structure, wherein the user can grip and move the pair of adjacent plates relative to each along the vertical interfacial axis to control a frictional resistance between the descent mechanism and the strap to control the rate of descent of the user along the strap.

2. The personal rescue device according to claim 1, wherein the control mechanism comprises two connector bars having ends directly pivotably attached to the pair of adjacent plates for setting a disposition of the opposing edge faces thereof relative to one another.

3. The personal rescue device according to claim 1, wherein the personal rescue device is configured so that the rate of descent of the user is automatically controlled and is determined according to the weight of the user.

4. The personal rescue device according to claim 1, wherein the body harness further includes an inflatable covering for protecting the user from possible blows or injury during descent.

5. The personal rescue device according to claim 4, wherein the inflatable covering surrounds the user from a waist of the user to above a head of the user.

6. The personal rescue device according to claim 5, wherein the inflatable covering is provided with a clear window to allow the user a view.

7. The personal rescue device according to claim 1, wherein a disposition of the opposing edge faces of the descent mechanism is pre-set for a predetermined weight range of the user thereby providing a safe descent rate for the user.

8. The personal rescue device according to claim 1, wherein a disposition of the opposing edge faces of the descent mechanism are configured to be set by the user in relation to a weight of the user, or a desired descent rate of the user.

9. The personal rescue device according to claim 1, wherein the descent mechanism further comprises a strap straightening member to ensure the strap is not tangled when entering the opposing edge faces of the descent mechanism.

10. The personal rescue device according to claim 9 wherein the strap straightening member includes a first side member having a flat face and a second side member having a flat face, and wherein a disposition of the first and second side members is such that the flat face of the first side member and the flat face of the second side member are aligned with the opposing edge faces of the pair of cooperating plates.

11. The personal rescue device according to claim 10 wherein the first side member further includes retaining arms extending from edges of the flat face.

12. The personal escape and rescue device according to claim 11, further comprising a second strap straightening member mounted at a top portion of the pair of the adjacent plates.

13. The personal rescue device according to claim 1, wherein the strap is provided with a weight at a lower end of the strap to aid in lowering the strap and preclude tangling of the strap.

14. The personal rescue device according to claim 13 wherein the weight includes a rubber covering.

15. The personal rescue device according to claim 1, further comprising a back-up descent mechanism attached to the harness and arranged in series with respect to the descent mechanism.

16. The personal rescue device according to claim 15, wherein the back-up descent mechanism is identical to the descent mechanism.

17. The personal escape and rescue device according to claim 1 wherein the undulating surfaces each include at least one friction element.

18. The personal rescue device according to claim 1 wherein the control mechanism includes two connector bars directly attached to the pair of adjacent plates for setting a disposition of the opposing surfaces relative to one another, and wherein the two connector bars are each configured to pivot at an end thereof so that the pair of adjacent plates move relative to one another in a direction substantially parallel to the interfacial axis along the edge faces of the pair of adjacent plates.

19. The personal rescue device according to claim 18 wherein said control mechanism includes a lever, and wherein the lever is configured to move the two connector bars.

20. A personal rescue device for allowing a user to descend from a building or tall structure, the personal rescue device comprising:

a strap;

an anchoring arrangement connected to the strap, the anchoring arrangement configured for securing the strap to or within the building or tall structure;

a descent mechanism connectable to the strap, the descent mechanism comprising a pair of adjacent plates configured to define a vertically oriented undulating passageway between the adjacent plates for accommodating the strap when extending through the descent mechanism, the pair of adjacent plates having opposing edge faces oriented parallel relative to each other along a vertical interfacial axis, each edge face having an undulating surface comprising at least one peak positioned on one edge face cooperating with at least one trough positioned on the other edge face, the descent mechanism being configured to preclude displacement of the pair of adjacent plates towards one another along a direction transverse to the interfacial axis;

a control mechanism connected to the pair of adjacent plates, the control mechanism being configured for displacing the pair of adjacent plates in opposite directions along the vertical interfacial axis for adjusting relative positioning of the undulating surfaces of the opposing edge faces of the pair of adjacent plates to reduce a vertical oriented gap between the at least one peak of the one undulating surface and the at least one trough on the other undulating surface of the edge faces of the pair of adjacent plates;

a body harness connectable to the descent mechanism for securely supporting the user descending the building or tall structure wherein the user can grip and move a first plate of the pair of adjacent plates opposite relative to a second plate of the pair of adjacent plates along the vertical interfacial axis to control a frictional resistance between the descent mechanism and the strap to control a rate of descent of the user along the strap.

* * * * *